US011363689B2

(12) United States Patent
Huguet Ferran et al.

(10) Patent No.: US 11,363,689 B2
(45) Date of Patent: Jun. 14, 2022

(54) METHOD FOR GENERATING LIGHT SPECTRA AND CORRESPONDING DEVICE

(71) Applicants: Universitat de Barcelona, Barcelona (ES); Enlighting Technologies S.L., Barcelona (ES)

(72) Inventors: Adrià Huguet Ferran, Barcelona (ES); Blas Garrido Fernández, Esplugues del LLobregat (ES); Sergio Hernández Márquez, Castellbisbal (ES)

(73) Assignees: UNIVERSITAT DE BARCELONA, Barcelona (ES); ENLIGHTING TECHNOLOGIES S.L., Barcelona (ES)

( * ) Notice: Subject to any disclaimer, the term of this patent is extended or adjusted under 35 U.S.C. 154(b) by 0 days.

(21) Appl. No.: 17/266,504

(22) PCT Filed: Jul. 31, 2019

(86) PCT No.: PCT/EP2019/070610
§ 371 (c)(1),
(2) Date: Feb. 5, 2021

(87) PCT Pub. No.: WO2020/030493
PCT Pub. Date: Feb. 13, 2020

(65) Prior Publication Data

US 2021/0307141 A1 Sep. 30, 2021

(30) Foreign Application Priority Data

Aug. 8, 2018 (EP) ..... 18382600

(51) Int. Cl.
*H05B 45/22* (2020.01)
*H05B 47/11* (2020.01)
*H05B 47/16* (2020.01)

(52) U.S. Cl.
CPC ..... *H05B 45/22* (2020.01); *H05B 47/11* (2020.01); *H05B 47/16* (2020.01)

(58) Field of Classification Search
CPC ..... H05B 45/00; H05B 45/20; H05B 45/22; H05B 47/00; H05B 47/10; H05B 47/11; H05B 47/16
See application file for complete search history.

(56) References Cited

U.S. PATENT DOCUMENTS

2006/0158881 A1* 7/2006 Dowling ..... G03G 15/0435 362/231
2012/0176042 A1 7/2012 Hatley et al.
(Continued)

OTHER PUBLICATIONS

International Search Report for corresponding PCT application PCT/EP2019/070610, dated Nov. 7, 2019, 3 pgs.
(Continued)

*Primary Examiner* — Jimmy T Vu
(74) *Attorney, Agent, or Firm* — Crowell & Moring LLP

(57) ABSTRACT

Method for generating light spectra and corresponding device. Starting from a plurality of light sources (2), comprising the steps of selecting a target colour from a target region (7) of a colour space, and emitting a target light (6) from said light sources (2) according to a weighted combination of light sources (2) corresponding to said target colour, using an output model (3) which is optimized according to an optimization parameter, and previously determined in a modelling stage comprising: —calculating a plurality of mixed spectra (4), as weighted combinations of said plurality of light sources (2), their colour coordinates and their optimization parameters; —partitioning in sectors a modelling region (5) of said colour space; —for each sector, selecting the mixed spectrum having the best optimization parameter; thus obtaining an optimized weighted combination; —using the optimized weighted combinations, estab-
(Continued)

lishing a correspondence between colours and weighted combinations; —thus obtaining said output model (3).

15 Claims, 9 Drawing Sheets

(56) References Cited

U.S. PATENT DOCUMENTS

| | | | | |
|---|---|---|---|---|
| 2013/0082622 | A1 | 4/2013 | Tien et al. | |
| 2013/0214704 | A1 | 8/2013 | Gerlach et al. | |
| 2016/0334278 | A1 | 11/2016 | Rector et al. | |
| 2018/0014375 | A1* | 1/2018 | Dupras | F21K 9/62 |

OTHER PUBLICATIONS

Written Opinion of the International Searching Authority for correspondent PCT application PCT/EP2019/070610, dated Nov. 7, 2019, 6 pgs.

* cited by examiner

METHOD FOR GENERATING LIGHT SPECTRA AND CORRESPONDING DEVICE

PRIORITY

This application is the U.S. National Stage application of PCT application no. PCT/EP2019/070610, filed on Jul. 31, 2019, titled METHOD FOR GENERATING LIGHT SPECTRA AND CORRESPONDING DEVICE, designating the United States, the content of which is incorporated herein by reference in its entirety. PCT application no. PCT/EP2019/070610 claims priority from European application no. 18382600.7 filed on Aug. 8, 2018, the contents of which are incorporated herein by reference in their entirety.

FIELD OF THE INVENTION

The invention relates to a method for generating a target light starting from a plurality of light sources, each light source having an individual emission spectrum, comprising the steps of:

selecting a target colour from a target region of a colour space; and emitting a target light from said light sources according to a weighted combination of light sources corresponding to said target colour.

The invention also relates to the corresponding device.

STATE OF THE ART

In the field of illumination, some solutions aimed to emulate particular light characteristics using a combination of different light sources are known.

For example, the solution disclosed in ES2527555 try to replicate the spectral characteristics of a light source using a combination of different quasi-monochromatic lights, in particular a large amount of Light Emitting Diodes, LEDs, that emit in different wavelengths. The method is based in dividing the objective spectrum in small sections and assigning at least one of said monochromatic LEDs to each section. Thus obtaining a combination of LEDs (i.e. a combination of the relative intensities of each LED) that closely renders the objective light source. In this case, the light characteristic to obtain is the emission spectrum of the light.

Nevertheless, the most common examples are related to creating light emission devices that are able to emit a particular colour by a combination of, for example, an array of 3 types of LEDs, typically red, green and blue, often called RGB. Since every type has a particular emission spectrum, controlling the output colour that a human being will perceive from said light sources can be achieved by individually controlling the output power of each type of LED. The biological reason for that possibility is due to the way humans and other species perceive the colour: in the retina of the eye are located colour detectors named cones. A common human being has three types of said cones, namely L, M and S. The three types of cones have pigments that respond best to light of long (around 560 nm), medium (around 530 nm), and short (around 420 nm) wavelengths respectively. This is called trichromatic colour vision or trichromatism.

This colour perception has given rise to a formulation and evolution of colour theories that model how to obtain a particular colour as a combination of basic colours. There are two different types of these combinations: additive colours and subtractive colours. The former relates to the combination of emitted colours (i.e. light), while the latter relates to the combination of absorbed colours, and is particularly used with pigments. The most widely known examples of these applications are television screens and colour printers, where the colour of each pixel of the image is obtained by a combination of additive colours (screens), or subtractive colours (printers). Unless stated otherwise, all following references about colour combinations will relate to additive colour, since the technical area of the invention relates to light emission.

As described above, the human eye has three types of colour sensors, each responding to different ranges of wavelengths. Note that the wavelength response is not just for a particular wavelength, but follows a Gaussian-like function. Given that three components, a representation of the full plot of all visible colours is a three dimensional figure. In order to distinguish different lights, it is very common to divide the concept of colour into two parts: brightness (also referred as luminance or luminosity), and chromaticity. In order to illustrate this differentiation, a pure white colour and a medium grey colour share the same chromaticity but their brightness differ, the former being brighter than the later. It is common in the art that, when referring to a colour, only the chromaticity components are involved, and not the brightness of the light.

Among the different additive colour models, that based in the combination of red, green and blue lights, also called RGB colour model, is the most widely used. Based on said RGB colour model, the colour theorists have designed a plurality of RGB colour spaces. A colour space is a mathematical representation of each colour as a combination of components or parameters. Each colour space has its own definition of parameters, in the case of RGB colour spaces, they are typically mathematical combinations of the base red, green and blue components. Some of said colour spaces are aimed to divide the components as stated above, thus differentiating luminance and chromaticity parameters. Among them, one of the main references regarding these kind of colour spaces is the CIE 1931 XYZ colour space (often named CIE XYZ) that was created by the International Commission on Illumination, CIE, in 1931. It is not the purpose of this document to describe the particularities of this colour space, it suffices to say that the CIE XYZ colour space was deliberately designed so that the Y parameter is a measure of the luminance of a colour, while the chromaticity is specified by two derived parameters named x and y. In that sense, this derived colour space is sometimes referred as CIE xyY, or simply CIE xy. It is to notice that, even if the CIE xyY and the CIE XYZ colour spaces are not exactly the same, the former is derived from the latter and they are often indistinctly mentioned in the art.

This way, not considering the luminosity, the range of chromaticity visible by an average person can be represented in a two-dimensional diagram with the parameter x in the horizontal axis and the parameter y in the vertical axis. The CIE 1931 chromaticity diagram is a closed figure that has the general form of an upside down U inclined to the left. The lower right region corresponds to red colours, the upper region to green colours and the lower left region to blue colours. The point corresponding to white, that is the equal energy point that has the same energy in all the wavelengths of the visible spectrum, is located in the central region. In addition, the outer curved boundary is called spectral locus, and it corresponds to the colours of monochromatic lights, that is, lights with a narrow band of wavelengths. Thus, each point of the spectral locus can be associated to a single wavelength and usually expressed in nanometres. The rest of the area correspond to non-monochromatic colours and thus are combinations of different colours. The CIE 1931 XYZ has become a standard in the colour applications. Moreover, it is very common in the art to refer only to the chromaticity components xy when referring to colour representations in that colour space, using the chromaticity diagram for representation. It should be noted that the chromaticity diagram is, in fact, a projection of the colour space three-dimensional curve in the plane formed by x and y components. In this sense, it is also widely used in the art the term colour space to refer only to the chromaticity components of a particular colour space. In fact, the term colour space is often used in the art to refer to the chromaticity diagram area of that colour space. This common nomenclature will also be used in this document unless stated otherwise. Chromaticity diagram is sometimes also referred as colour diagram. Every point in a chromaticity diagram corresponds to a colour; in particular, the point coordinates in that chromaticity diagram are the components representing the chromaticity of that colour in said colour space.

Other colour spaces are also known in the art. A colour space is said to have perceptual uniformity if a small perturbation of a component produces a change in colour that is approximately equally perceptible across the colour space. As an example of colour space with perceptual uniformity, in the art is known the CIE 1976 L*u*v*, published by the International Commission on Illumination as CIE S 014-5/E:2009 and having an associate chromaticity diagram named u'v'. This colour space and its chromaticity diagram is commonly referred as CIELUV.

The term locus used above is a mathematical term used for a set of points whose locations satisfies or is determined by one or more specified conditions, commonly representing a line, a line segment, a curve or a surface. In the case of colour theory, one special case is called Planckian locus or blackbody locus. It corresponds to the path that the colour of an incandescent blackbody would take in a particular chromaticity diagram as the blackbody temperature changes, and it is often represented in the CIE 1931 XYZ colour space. It goes from deep red at low temperatures through orange, yellowish white, white and finally bluish white at very high temperatures. A blackbody radiator, or Planckian radiator, is a source that emits blackbody radiation. This type of radiation contains all wavelengths, and the spectral distribution (called spectrum) of light emitted from a blackbody is a function of its temperature only. Therefore, each point of the Planckian locus defined above corresponds to a temperature of a blackbody radiator, usually given in Kelvin and referred as Colour Temperature. Somewhat confusingly, in the art low CT colours (reddish) are referred as warm, whilst high CT colours (bluish) are referred as cool.

One of the reasons of the importance of the Planckian locus is the fact that the Sun closely approximates to a blackbody radiator. As is generally known, on the surface of the Earth the colour of the sunlight varies through the day, which is mainly a result of the scattering of the light in the atmosphere. Nevertheless, daylight has a spectrum similar to that of a blackbody. Therefore, the colours of the points of the Planckian locus resemble to the sunlight. Another example of a blackbody radiator is an incandescent radiator, for example, those found in incandescent light bulbs. Other types of more efficient light sources, for example LEDs or fluorescent lamps, cannot be considered as blackbody radiators. In order to evaluate those light sources, it was introduced a parameter called Correlated Colour Temperature, CCT. Its quantitative calculation falls out of the scope of this document, but an informal definition is that the CCT of a light source is the blackbody temperature that the source resembles most closely. It is reported in units of Kelvin. Thus, CCT is a measure of light source colour appearance defined by the proximity of the light source's chromaticity coordinates to the blackbody locus. CCT values are intended by the lighting industry to give specifiers a general indication of the quality of apparent "warmth" or "coolness" of the light emitted by the source.

CCT alone is not generally enough to determine the quality of a light source. Indeed, the form of the spectrum of a particular light source has an effect when illuminating the environment. This way, the colours revealed in the illuminated objects can appear very different for two light sources with the same CCT if their spectral components are very different. In particular, when the spectrum of a light source diverges from an ideal source like an incandescent lamp or daylight, said revealed colours could seem unnatural or unrealistic. In order to determine how far a particular colour from the Planckian locus is, usually the parameter Duv is used. Duv is a dimensionless value that measures the distance from the Planckian locus using the CIE 1960 (u, v) colour space coordinates and, therefore, the degree of colour deviation from said curve. Positive Duv values are above the curve, while negative Duv values are below the curve. Those skilled in the art will understand that Duv and CCT can also be used as a colour space for the method, in particular using CCT as the horizontal axis, measured in Kelvin (K) and the Duv as the vertical axis, thus defining a chromaticity diagram, that is particularly advantageous for determining the relationship between the distance from the Planckian locus relative to a colour temperature for a light source.

This also led to the establishment of a quality indicator parameter known as Colour Rendering Index, CRI. CRI is a quantitative measure of a light source's ability to show object colours realistically or naturally compared to a familiar reference source, either incandescent light or daylight. A CRI of 100 represents the maximum value. Lower CRI values indicate that some colours may appear unnatural when illuminated by the lamp. Incandescent lamps have a CRI above 95. Typical cool white fluorescent lamps have a CRI value around 60. However, fluorescent lamps containing rare-earth phosphors are available with CRI values of 80 and above. The CRI of a light source does not indicate the apparent colour of said light source, which is commonly given as a CCT. In the lighting industry is common that a light source specification includes its CCT and CRI. Other parameters are also used in the art in order to quantify the quality of a light source. It is not the purpose of this document to describe in detail the calculation of these quality indicator parameters since they are well known in the art, nevertheless a brief description of their main concepts and benefits will be included hereinafter.

Colour Fidelity of a light source quantifies its ability to show object colours realistically or naturally compared to a reference source. Typically, the maximum value of a Colour Fidelity parameter is 100, corresponding to the maximum quality of the light source. Lower values correspond to worse light sources in terms of Colour Fidelity. There are several known Colour Fidelity parameters, among them one is the Colour Rendering Index, CRI, described above. Other known Colour Fidelity parameters are Colour Quality Scale, CQS, and IES TM-30-15 Rf. Colour Quality Scale is derived from CRI, and its values range from 0 to 100, being 100 the best possible indicator and 0 the worst. While CRI is based the comparison with desaturated samples, CQS use more saturated ones.

The IES TM-30-15, hereinafter also referred as TM-30, describes a group of measures based in a set of colour evaluation samples statistically selected from a library of approximately 105,000 spectral reflectance function measurements for real objects, which include paints, textiles, natural objects, skin tones, inks and others. One of the measures described in the IES TM-30-15 is the IES TM-30-15 Rf, hereinafter also referred as TM-30 Rf. TM-30 Rf ranges from 0 to 100 and offers improved uniformity over CRI.

Colour Gamut of a light source quantifies how saturated are the colours of the objects illuminated by said light source, compared to a reference source. Typically, Colour Gamut parameters range from 0 to 100, and can reach values greater than 100 resulting in an oversaturated colour rendering. Among Colour Gamut parameters, the Gamut Area Index, GAI, measures the relative separation of the colours in an illuminated object. In addition, IES TM-30-15 Rg, hereinafter also referred as TM-30 Rg, is a Colour Gamut parameter described in the IES TM-30-15.

The Luminous Flux, LumFlux, is a photometric quantity that represents the light power of a source as perceived by the human eye. Sensitivity to brightness during daytime is given by the so-called photopic luminous-efficiency function, which is a function of wavelength. This function allows measuring the total quantity of visible light emitted by a light source. In the International System of Units, the LumFlux is measured in lumens (lm). Luminous Flux is not used to compare brightness, as this is a subjective perception that varies according to the distance from the light source and the angular spread of the light from the source. Indeed, LumFlux measures the total amount of light emitted by a light source.

Biological Flux measures the biological effects of light on humans in a similar way than the Luminous Flux described above, but using a so-called circadian function instead of the photopic luminous-efficiency function. It can be defined as the light power perceived by the circadian and neuroendocrine regulation human system. In order to distinguish from the LumFlux measures, in this case the units are called biolumens (biolm).

Circadian Factor is the ratio between the Biological Flux and the Luminous Flux. For the same values of LumFlux, higher values of the Circadian Factor can be associated to more presence of blue components in the light.

Radiant Flux is a measure of the rate of flow energy emitted, usually measured in watt (W). Luminous Efficacy of Radiation, LER, is the ratio between the Luminous Flux and the Radiant Flux. Therefore, it measures the efficiency of illumination in regards of human perception.

Energy Efficiency measures the relation between the luminous flux and the power consumption of the light sources, measured in lm/W.

In the field of illumination, several known solutions use the ideas discussed above in order to simulate different colours, the most common applications relate to simulate daylight in interiors of buildings. These solutions often use a combination of light sources of different types and use CRI as an optimization parameter. The most basic solutions use a combination of three types coloured LEDs: red, green and blue. According to the colour theory briefed above, a combination of these light sources can be used to simulate a wide range of points in the CIE XYZ colour space. Even so, due to the restricted range of emission of the LEDs, as a rule, the range of possible simulated colours cannot cover the whole CIE xy chromaticity diagram, but in general, most of the points in the Planckian locus can be achieved. Nevertheless, the spectral characteristics of the LEDs differ from the daylight, and thus, the resulting light might lead to unnatural effects when illuminating objects. This is partially solved with two strategies: selecting LEDs with a high CRI, and adding extra LED types. The later strategy often includes the usage of white LEDs with high CRI. This way, the base of the illumination is done with those white LEDs, while the other coloured LEDs are used for changing the apparent colour of the emitted light.

Even if the problem is partially solved with the above strategies, this solution can be applied only to a particular application: illumination simulating daylight. Moreover, it has been discussed in the art if CRI is a suitable measure in the case of LEDs. Indeed, due to the particularities of the spectrum of the LEDs, the emitted light can achieve a high CRI value and still seem unnatural when illuminating objects. Among other things, LEDs usually have a peak of emission in the blue components of the spectrum, which does not correspond with a natural (daylight) light characteristics.

Current known solutions are sometimes able to render light along part of the Planckian locus, and therefore they are suitable for applications such are following the cycle of daylight. These applications instead of a target region have a unidimensional (or almost unidimensional) target line that corresponds to part of the Planckian locus. Other solutions simply render a specific spectrum or a small subset of spectra. However, a general approach that can be used for a wide range of applications is not known.

US 2013/214704 A1 (GERLACH ROBERT G [US] ET AL) discloses methods, luminaires and systems for matching a composite light spectrum to a target light spectrum are disclosed. Method embodiments may be optimized for simultaneously maximizing luminous output with minimal chromaticity error. Method embodiments may further be optimized for simultaneously minimizing both chromaticity and spectral error. Embodiments of the present invention maybe used with composite light sources having four or more distinct dominant colors within the visible spectrum.

One of the main underlying problems of colour light rendering is that, for each point of the chromaticity diagram corresponding to a colour it can exist an infinite number of different spectral distributions that can generate that particular colour. While it is relatively simple to evaluate which point in the chromaticity diagram corresponds to a particular spectrum, a general approach for the reverse procedure is not obvious. On the other hand, full spectral replication has the drawback of being difficult to accomplish: if using monochromatic sources the efficiency is low, while if using light sources closer to a white spectrum, an accurate replication can be impossible.

Moreover, different applications require different considerations about the characteristics of the light to be generated. One of the possible applications is to render light similar to daylight. Other applications such are energy efficiency, particular working environments, etc. do need other parameters for the characteristics of the light. Therefore, it is needed a general method for generating light with the desired colour perception but optimised according to different needs, and not only restricted to the Planckian locus.

Besides, the current state of art for rendering specialized light spectra is often directed to enhance specific colours. For example, in the case of photolithography where yellow light without blue components is used. Similar cases are in the food industry where red-enhanced lights are used for increasing the appealing of meat. Nevertheless, in all these cases, the rendered light is hardly comfortable for the users, because the strong increment of some colours leads to artificial illumination.

SUMMARY OF THE INVENTION

It is an object of the invention to overcome the problem stated above. This purpose is achieved by a method for generating a target light of the type indicated at the beginning, characterized in that, for said target colour, said weighted combination is obtained from an output model which is optimized according to an optimization parameter, and wherein said output model is previously determined in a modelling stage comprising the following steps:

- calculating a plurality of mixed spectra, each being a weighted combination of said individual emission spectra of said plurality of light sources;
- for each mixed spectrum of said plurality of mixed spectra, calculating its colour coordinates and its optimization parameter;
- partitioning in sectors a modelling region of said colour space;
- for each sector, selecting an optimized mixed spectrum as the mixed spectrum contained in said sector having the best optimization parameter; thus obtaining an optimized weighted combination for said colour sector, as the weighted combination of said optimized mixed spectrum;
- using the optimized weighted combination of each of said sectors, establishing a correspondence between colour coordinates and weighted combinations;
- thus obtaining said output model.

Those skilled in the art will understand that the different steps do not need to be performed in the exact sequence stated above in order to reach the same results, and therefore, equivalent step sequence is also covered by the description above. In addition, the method above can be used for more than one target colour, for example performing successive iterations. Besides, and unless stated otherwise, each light source can refer to an individual radiating element or a plurality of them, preferably, a plurality of individual elements with the same characteristics. Each of the plurality of light sources, being an individual radiating element or a plurality of individual radiating elements with the same characteristics is also referred as a channel. In a preferred embodiment, each of the individual radiating elements is a LED.

Therefore, the method starts selecting a target colour, that is, the colour that needs to be generated. Target colour selection depends on the nature of the application where the method is used. For example, following the daylight time or generating continuous light to highlight particular colours. Afterwards, it accesses to a previously generated output model for that colour. In cases where the output model does not include all the possible colours, for example, in the case of sampling, usual strategies such are selecting the closest sample or even interpolation are used. The output model contains a correspondence between colours (i.e. colour coordinates) and weighted combinations of said light sources that should be used to generate each colour. Therefore, accessing the output model for a colour will result in the weighted combination for said colour. Said weighted combination contains the relative weights of a linear combination of each of the plurality of light sources. Said target light is also known as rendered light since it corresponds to the emission of the different light sources with its corresponding relative weights. Thus, emitting a target light with a power distribution according to said weighted combination will result in generating a colour as close as possible to said target colour according to the output model; this will sometimes be referred as colour rendering. Those skilled in the art will understand that the emission step do not need to use exactly the weights of the weighted combination, as non-limiting examples, a multiplying factor can be used in order to emit with more or less luminosity for the same emission colour; likewise, non-linear responses of the light sources can be corrected during this step.

The modelling stage is aimed to obtain an output model optimized according to the optimization parameter. Using an output model, which is previously determined, instead of an on-the-fly calculation has the advantage that any device implementing this method lowers its requirements, both in terms of computing and power consumption. This, in turn, results in simpler devices that can be autonomous and have a reduced manufacture cost, contrary to the current state of art solutions where the devices are often connected to external computing systems, for example, a server or even a smartphone, in order to control the light-emitting device, including its brightness and colour parameters. In the case of this invention, there is no need for communication with external devices and thus, it can be used even in isolated environments where that communication is not possible.

Besides, the rendering is not based in a replication of a particular spectrum, but in an optimization parameter, which is a quantifiable quality indicator fit for the particular application where the invention will be used. In particular, it can be, for example, a direct parameter like CRI, or a combination of several relevant ones. The method generates a plurality of mixed spectra as weighted combinations of the light sources, the more combinations, the wider possible coverage of the chromaticity diagram. The optimization parameter is also calculated for each mixed spectrum. The colour space is partitioned at least for a modelling region and the best mixed spectrum for each sector in terms of optimization parameters is selected. Those skilled in the art will understand that selecting the best one depends on the nature of the optimization parameter. As an example, if the optimization parameter is the CRI, the criteria is to select the highest value. Other type of optimization parameters may have other requisites, for example, selecting the minimum value. Preferably, said modelling region is the region of the colour space where the colours have to be rendered, also referred as target region, thus depending on the application. In general, the modelling region will be smaller than the colour space since it is very unlikely for a particular set of light sources to be able to render all the possible colours. In addition, the target region is also generally equal or smaller than the modelling region, and is contained thereof. Partitioning and selecting can be achieved in multiple ways, some preferred embodiments use a grid, having non-overlapping sectors and then look for the best spectrum inside each sector, while other embodiments reverse these steps and first select the mixed spectra having a threshold quality in terms of the optimization parameter, and then partition the modelling region using said spectra as central points of each segment. Preferably, the method includes an interpolation step for determining a mixed spectrum for each of those sectors in the modelling region where no available optimized mixed spectrum has been found. When the sectors have an optimized mixed spectrum, and therefore, a corresponding weighted combination of light sources, the method establishes a correspondence at least for the modelling region. This correspondence can have multiple forms; preferably, it is based in a look-up table or matrix where each sector is associated with a weighted combination. In this case the target region is contained in the modelling region and shares the same sectors or a subset thereof. In some preferred embodiments, the points in the target region are decimated in order to reduce the total number of points, therefore minimizing memory needs in the rendering devices. Another preferred embodiment uses a surface function for each of the channels, which returns the weight of the channel as a function of colour coordinates at least for said target region. The output model is thereby obtained.

Therefore, the method described above, is able to generate light simulating a target colour, and having spectral characteristics that are optimized in regards of an optimization parameter. The skilled person will understand that, being a heuristic method, the usage of the word "optimized" does not necessarily mean the best possible solution in a strict mathematical sense, but a suitable approximation. Another benefit of the method is that the modelling region does not need to be a line. Therefore, as an example, the method can be used for generating optimized spectra even at a distance from the Planckian locus. Indeed, known solutions are often able to render high quality light when the target colour is located in the Planckian locus, but they are not capable to render light with a desired quality outside it. This is of particular importance for applications that diverge from simulating sunlight conditions.

A further advantage of the method is that the requirements of the devices implementing the rendering stage are minimized. Indeed, for example, when using an output model that is based in look-up tables, the computational requirements are minimized. Likewise, when the output model is function-based, the memory requirements are minimized. Even in the case of look-up tables, if the number of elements is not very large, the overall memory requirements are still low. This allows to use common elements such are low cost microcontrollers that can process and store the output model, thus avoiding any requirement for external computing elements. Therefore, the cost of these kind of rendering devices is kept to a minimum, also avoiding the need for communication elements, antennas, data protocol stacks, etc.

The invention further includes a number of preferred features that are object of the dependent claims and the utility of which will be highlighted hereinafter in the detailed description of an embodiment of the invention.

In a preferred embodiment, said colour space has perceptual uniformity. Preferably, said colour space is CIE 1976 L*u*v*, published by the International Commission on Illumination as CIE S 014-5/E:2009. Perceptual uniformity has the particularity that for near points a geometric distance on the diagram corresponds to a perceived colour difference and that correspondence is uniform across the diagram. Since the method relies on determining colours based on the colour of the nearby mixed spectra, this particularity leads to consistent results across the chromaticity diagram.

Preferably, said optimization parameter comprises a Colour Fidelity parameter, therefore focusing in realistic colour rendering comparing the light emission with referent source.

Preferably said Colour Fidelity parameter is Colour Rendering Index, CRI. Since it is still the standard quality indicator, it allows to render light with a spectrum that can be easily compared to others lights in the market by a person skilled in the art.

Preferably, said Colour Fidelity parameter is Colour Quality Scale, CQS. Even if CRI is still today a standard quality indicator of a light source, it has severe limitations due to its particular form of calculation. Indeed, even high CRI sources can in fact perform poorly in terms of colour rendering. Besides, since CRI is based on desaturated samples it even penalizes the light sources for showing increases in object chromatic saturation compared to reference lights, which is actually desirable for many applications. In contrast, CQS is based on more saturated samples and it is a better indicator for the quality of a light source.

In a preferred embodiment, said Colour Fidelity parameter is IES TM-30-15 Rf, which offers improved uniformity over CRI and, therefore, allows more accurate calculations of colour differences, which in turn means that more accurate results can be obtained.

Preferably, said optimization parameter comprises a Colour Gamut parameter. In general, when comparing the quality of a light source in terms of Colour Gamut, the one having a value closer to 100 is considered the best. Nevertheless, in applications where the objective is saturating colours as much as possible, the best light source is the one having the greatest Colour Gamut. As a non-limiting example, applications aimed to illuminate fruits in a supermarket, where saturation leads to products that seem more appealing for the consumer. Preferably said Colour Gamut parameter is one of, Gamut Area Index, GAI, or IES TM-30-15 Rg.

Preferably, said optimization parameter comprises the Circadian Factor. Since the presence of blue light affect the circadian regulation, the specific application to which the illumination is aimed for guides the criterion for selecting the best parameter. Thus, applications aimed to replicate the natural light effects in the circadian rhythms will generally follow the Planckian locus and require lower Circadian Factor values. In contrast, applications aimed to increase the awareness and concentration of individuals will require higher values.

Preferably, said optimization parameter comprises the Luminous Efficacy of Radiation, LER. Since it measures the efficiency of illumination in regards of human perception, higher values correspond to illumination that is more efficient, which is usually a desirable effect.

Preferably, said optimization parameter comprises the Energy Efficiency. In general, this is a parameter given by the manufacturer for each light source. For the plurality of light sources, the total energy efficiency is measured for the combination of all of them, according to their particular set of weights. This is a preferred quantitative indicator parameter for applications aimed to minimize energy consumption.

In an alternative embodiment, said optimization parameter comprises a combination of two or more of the parameters discussed above, for example a weighted combination. Therefore, it is possible to use a complex indication and finely adapt the resulting quality of the rendered light according to a particular application.

Preferably, said output model comprises:

- a look-up table relating ranges of colour coordinates with a corresponding weighted combination; or
- a plurality of individual look-up tables, one for each light source of said plurality of light sources, and each relating ranges of colour coordinates with a corresponding weight of its corresponding light source.

Therefore, the output model can be stored in the form of a look-up table, for example, where each sector of the target region is related to its optimized weighted combination, or, alternatively, one look-up table for each of the light sources, that is, for each of the weights of the weighted combination. The first case is particularly advantageous when the shapes of the sectors are complicated, which can increase the computational cost of finding the ranges. In other cases, in particular, when the sectors are squares, both options can be equivalent. In both cases, these preferred embodiments are particularly advantageous in order to minimize the computational cost, even if it requires sufficient memory for storing the output model. In addition, in these cases the target region is contained in the modelling region and shares the same sectors or a subset thereof.

In another preferred embodiment, said output model comprises:

- a mathematical function having as an input colour coordinates and having as an output a corresponding weighted combination; or
- a plurality of independent mathematical functions, one for each light source of said plurality of light sources, and each having as an input colour coordinates and having as an output a corresponding weight of said light source.

Therefore, the resulting weighted combination is obtained by calculating the result of one or several functions in terms of the colour coordinate of the target colour. In particular, said functions can be obtained from a function fitting starting from the segments and their correspondent optimized mixed spectra. Function result calculations could increase the computational requirements compared to some previous described embodiments. Nevertheless, this has a number of advantages: the required storage memory is minimal, the range calculation can be avoided, and said functions have the effect of smoothening the results. Therefore, no further interpolation steps or similar strategies are needed.

Preferably, said plurality of light sources comprise LEDs of different types. Even if LEDs typically have relatively low Colour Fidelity values, which means that their emitted light quality is not very high, the method itself can improve the resulting quality of the rendered light. In addition, LEDs are efficient, durable and have a low manufacturing cost. Therefore, using LEDs for the method of the invention is particularly advantageous since it is possible to render high quality but efficient light, while minimizing the manufacturing cost.

Preferably, said plurality of light sources comprise at least 3 types of LEDs. It has been found, by analysing the resulting models and spectra, that it is very unlikely to obtain good results using the LEDs available in the market unless at least three types are used in combination. A preferred embodiment uses at least the following types of LEDs:

- red, preferably having an emission wavelength between 600 and 700 nm;
- green, preferably having an emission wavelength between 500 and 570 nm;
- blue, preferably having an emission wavelength between 400 and 490 nm;
- warm white, preferably having colour temperature between 2,000 and 3,500 K; and
- cold white, preferably having colour temperature between 4,000 and 10,000 K.

Therefore, white LEDs can be used as a basis for illumination, since their luminous efficiency is greater than monochromatic LEDs. Indeed, red, green and blue LEDs able to emit with a high light power are still relatively expensive, while the white LEDs are able to generate a powerful base of illumination at a reduced manufacturing cost. Thus, the monochromatic LEDs are used to model the spectrum with the required chromaticity characteristics. Finally, the combined used of warm and cold LEDs has the advantage that they can be combined to equalize the resulting spectrum that otherwise should be compensated with the monochromatic LEDs, which are less efficient. Some preferred embodiments use only one type of white led, warm or cool, together with the monochromatic red, green and blue LEDs, for example for applications aimed to particular warm or cold regions of the chromaticity diagram.

Another object of the invention is a device for generating target lights having:

- a power source;
- a plurality of light sources, each having at least one light radiating element;
- a control module having storage means; and
- powering means for said plurality of light sources, said powering means being controlled by said control module;

said control module being configured to:

- selecting a target colour from a target region of a colour space; and
- controlling said powering means for driving said plurality of light sources to emit a target light according to a weighted combination of light sources;

characterized in that, said control module is further configured to, for said target colour, obtaining said weighted combination from an output model which is optimized according to an optimization parameter, and wherein said output model is previously determined in the modelling stage of the method according to any of the claims 1 to 6.

Therefore, the device is able to implement the method described above. For de sake of conciseness, the technical effects and details purely related to the method will not be repeated here. Preferably, said output model is stored in the storage means of the control module, in particular in a memory module, accessible from the control module to retrieve the weighted values for the target colour to be rendered.

The invention also relates to a device for generating target lights having:

- a power source;
- a plurality of light sources, each having at least one light radiating element;
- a control module having storage means; and
- powering means for said plurality of light sources, said powering means being controlled by said control module;

said control module being configured to:

- selecting a target colour from a target region of a colour space; and
- controlling said powering means for driving said plurality of light sources to emit a target light, having an emission colour from a plurality of emission colours, according to a weighted combination of light sources;

characterized in that, said control module is further configured to, for said target colour, obtaining said weighted combination from an output model; said target colour being selectable by said control module at least for said target region;

wherein at least a 50% of those emission colours of said plurality of emission colours that are located within said target region fulfil a quality criterion, said quality criterion comprising having a Colour Fidelity parameter, preferably IES TM-30-15 Rf, with a value of at least 50, preferably at least 60, more preferably at least 80;

said target region being defined by the area contained in any of a first ellipse and a second ellipse, both ellipses described by the general formula:

$$\frac{((x-h)\cos(A)+(y-k)\sin(A))^2}{a^2}+\frac{((x-h)\sin(A)-(y-k)\cos(A))^2}{b^2}=1$$

wherein x corresponds to CCT, measured in Kelvin (K); and y corresponds to Duv;

wherein, for said first ellipse:

h=3650 k=−0.0025

A=8.737×10$^{-6}$ in radians a=900 b=0.012 and for said second ellipse:

h=5050 k=0.0045

A=1.745×10$^{-6}$ in radians a=550 b=0.0032.

The emission colour of said target light correspond to its chromaticity components. The plurality of emission colours correspond to the range of colours that can be rendered by the device. The fact that the target colour is selectable at least for a target region implies that the control module can select any of the points (that is, colours), within said target region. Those skilled in the art will understand that with real electronic components, and in particular in the case of digital electronics, said target region is often segmented, so the points are not necessarily continuous but can also be quantified in its values. In addition, the target region described above is defined in terms of Duv and CCT, where the Planckian locus lies in the line of Duv=0. This criterion only corresponds to a useful definition for the region but said colour space used by the device can be any one that the device manufacturer considers well suited, for example CIELUV. Expressing colours in terms of Duv and CCT could be interpreted as a specialized colour diagram. In this regard, this document will sometimes refer it as Duv-CCT diagram or simply Duv-CCT. The region boundaries expressed in Duv-CCT are transformable to said colour space using mathematical conversions known in the art. Some examples of these transformations are given after in the document and the figures.

The inventors have found that having a device with an output model that is optimized for a bi-dimensional target region of the colour space instead of only the Planckian locus is particularly advantageous due to the wide range of applications where the device can be used. Indeed, this device can be used not only for common applications like simulating daylight, but also to generate light that deviates from the one corresponding to a blackbody radiator, but that still maintains a natural quality in terms of the colour rendering of the objects illuminated by that light, that is, the colours of the illuminated objects still seem natural. Moreover, the particular shape of the target region allows rendering light from an approximate CCT range of 2700K to 5500K, that is, from warm to cold zones of the spectrum, which is able to cover a wide range of possible applications. The whole scope of possibilities of this kind of applications are not yet totally envisaged since these kind of devices have not been available before. Some usage examples are given hereinafter.

In the field of photolithography, is particularly important that the light that is used has no blue or ultraviolet components present in order to avoid problems with the photoresistors. For the human eye, this kind of illumination has a very intense yellowish tone in the current state of art. When using the disclosed device, this zone corresponds approximately to the second quadrant of the first ellipse. Following this specification and selecting light sources without blue or ultraviolet components, allows using a suitable light that will illuminate the objects with a more natural look than in the current state of art. This also increases the safety for the human operators since they would distinguish more clearly the objects in the room where the photolithography process is taking place.

In the food industry, sometimes red lights are used for increasing the contrast of meat. The illumination of the objects for these lights result in artificial colours. Using a device like the one disclosed here, the red component can be enhanced while maintaining the colour fidelity of other colours. This corresponds approximately to the third quadrant of the first ellipse. Therefore, the general illumination will be much better for the human eye but, at the same time, the red components will be reinforced thus providing the required effect on the meat.

Similar effects are also used in clothing retail: using light having blue components to illuminate fabrics having pigments that react to those blue components, thus increasing the apparent brightness of said fabrics. Using the fourth quadrant of first ellipse, the device can generate light having enhanced blue components but keeping the other colours with a natural look.

In addition, it has been found that users sometimes prefer illumination that falls out of the Planckian locus. In particular, for CCT values over 4000K there seems to be a preference of light that is above the Planckian locus (positive Duv), while for CCT values under 4000K some users prefer light beneath the Planckian locus (negative Duv). These cases correspond to the first and third quadrants of the first ellipse, and also to the second ellipse. Using the disclosed device, preferred illumination can be achieved while keeping a natural look in the colours.

As those skilled in the art will understand, the general idea of many of the usages disclosed here is that a device as defined above allows generating light that enhances particular colour components while still maintaining a high quality of the light, and therefore, rendering colours that are more natural to the human eye compared to when using known state of the art devices.

Those skilled in the art will understand that the calculation the threshold ratio, that is, the percentage of the target region that has the required parameter, can be calculated in different ways if said target region is quantified (segmented) or if it is continuous. In the former case, the percentage is simply the number of points fulfilling the quality criterion in respect to the total number of possible points. In the latter case, when the point values can be continuous, it corresponds to the total area fulfilling the criterion in respect of the total area of the target region, represented in said colour space.

The output model used with this device is obtainable from the method described above when using a Colour Fidelity parameter as the optimization parameter. Other methods are also possible, for example, driving the device to generate random combinations of light from the light sources, measuring its parameters, and selecting those that have the threshold Colour Fidelity parameter stated above.

The main advantages and technical effects of a device capable to emit light in a target region, even outside of the Planckian locus, have been discussed before, therefore, it would be clear that expanding the area and/or increasing the quality of the light in respect to the target region defined by said first and second ellipses are advantageous preferred embodiments. It has been found by the inventors that, for example, when the output model is obtained with a method as described above, and using a Colour Fidelity parameter, in particular Rf, as the optimization parameter, it is possible to increase the area of the target region. Some embodiments of this option are disclosed hereinafter.

Preferably, said quality criterion comprises having an IES TM-30-15 Rf parameter with a value of at least 50; and wherein the perimeter of said target region is defined in a Duv-CCT diagram by straight lines, each successively connecting the following points:

P1: CCT=1411K, Duv=−0.0114;
P2: CCT=5869K, Duv=0.06;
P3: CCT=10000K, Duv=0.06;
P4: CCT=10000K, Duv=−0.0265;
P5: CCT=2576K, Duv=−0.0507; and
P6: CCT=1411K, Duv=−0.0114.

The result is a device that is able to render fair quality light even if extreme zones, very far from the Planckian locus. It will be clear for those skilled in the art that according to the description, each of said straight lines connect two of the points above. That is, a first line connects P1 and P2, a second line connects P2 and P3, and so on. This way, the last line finally encloses the target region by connecting P5 and P6, since the last point P6 has the same coordinates as the first point P1.

Preferably, said quality criterion comprises having an IES TM-30-15 Rf parameter with a value of at least 60; and wherein the perimeter of said target region is defined in a Duv-CCT diagram by straight lines, each successively connecting the following points:

P1: CCT=1573 K, Duv=−0.0123;
P2: CCT=6394 K, Duv=0.06;
P3: CCT=10000 K, Duv=0.06;
P4: CCT=10000 K, Duv=−0.018;
P5: CCT=2649 K, Duv=−0.0432; and
P6: CCT=1573 K, Duv=−0.0123.

In this embodiment the target region is reduced compared to the previous one, but, in contrast the device is able to render light with higher quality. In fact, the light quality rendered by the device is similar to those coming from a cool white fluorescent lamp, even for points far away of what is expected for a blackbody radiator.

Preferably, said quality criterion comprises having an IES TM-30-15 Rf parameter with a value of at least 70; and wherein the perimeter of said target region is defined in a Duv-CCT diagram by straight lines, each successively connecting the following points:

P1: CCT=1685 K, Duv=−0.0121;
P2: CCT=4046 K, Duv=0.0219;
P3: CCT=7946 K, Duv=0.0572;
P4: CCT=10000 K, Duv=0.0416;
P5: CT=10000 K, Duv=−0.0107;
P6: CCT=2797 K, Duv=−0.0353; and
P7: CCT=1685 K, Duv=−0.0121.

An Rf of 70 corresponds to a good quality light. Therefore, the device is able to render this good quality for colours as far as Duv of 0.0572, for a cool light, or Duv=−0.0353 for a warm light.

Preferably, said quality criterion comprises having an IES TM-30-15 Rf parameter with a value of at least 80; and wherein the perimeter of said target region is defined in a Duv-CCT diagram by straight lines, each successively connecting the following points:

P1: CCT=1946 K, Duv=−0.0083;
P2: CCT=3395 K, Duv=0.011;
P3: CCT=7456 K, Duv=0.04;
P4: CCT=10000 K, Duv=0.0122;
P5: CCT=10000 K, Duv=−0.0007;
P6: CCT=2971 K, Duv=−0.026; and
P7: CCT=1946 K, Duv=−0.0099.

An Rf of 80 corresponds to high quality light, which in this case is possible to be rendered for colours far from the Planckian locus.

Preferably, said quality criterion comprises having an IES TM-30-15 Rf parameter with a value of at least 90; and wherein the perimeter of said target region is defined in a Duv-CCT diagram by straight lines, each successively connecting the following points:

P1: CCT=2181 K, Duv=−0.0083;
P2: CCT=2851 K, Duv=0.002;
P3: CCT=6648 K, Duv=0.0221;
P4: CCT=7557 K, Duv=0.006;
P5: CCT=7458 K, Duv=−0.0008;
P6: CCT=3095 K, Duv=−0.0184; and
P7: CCT=2181 K, Duv=−0.0083.

This quality criterion corresponds to very high quality of light, similar to what can be obtained with an incandescent lamp. But in this device, this level of quality is possible from warm to cool lights and even for zones quite far from the Planckian locus. In this preferred embodiment, the target region with a more restrictive criterion does not contain all the area of said first ellipse. Nevertheless, those skilled in the art will understand that the device of this embodiment is able to render light for all of said first ellipse with at least the quality criterion used in the ellipse definition.

Preferably, for any of the devices disclosed above, said plurality of light sources comprise LEDs of different types, preferably at least 3 types of LEDs, more preferably at least the following types of LEDs:

red, preferably having an emission wavelength between 600 and 700 nm;
green, preferably having an emission wavelength between 500 and 570 nm;
blue, preferably having an emission wavelength between 400 and 490 nm;
warm white, preferably having colour temperature between 2,000 and 3,500 K; and
cold white, preferably having colour temperature between 4,000 and 10,000 K.

Preferably, for any of the devices disclosed above, said power source comprises an AC/DC converter with a first output voltage; and
a DC/DC converter, connected to said first output voltage and having a second output voltage, lower than said first output voltage;

wherein said first output voltage is connected to said powering means in order to power said plurality of light sources, and wherein said second output voltage is connected to said control module.

Therefore, a dual powering is possible for the different needs of the components using a single AC/DC converter and, thus, a single AC power connection. Preferably, said AC/DC converter AC input ranges from 80 to 305V, more preferably from 80 to 264V. Preferably said AC/DC converter DC output ranges from 6 to 80V, more preferably 24V. Preferably, said DC/DC converter input ranges from 6 to 80V, more preferably 24V. Preferably said DC/DC converter output ranges from 1.5 to 6V, more preferably 3.3V.

In preferred embodiments of any of the devices disclosed above, said powering means for said plurality of light sources use pulse-width modulation, PWM. This is particularly advantageous in order to achieve a linear response of the light sources depending on the power. Indeed, for example in the case of the LEDs, some saturation effects occur, in particular in when they are powered with high values. These non-linearity could lead to an inaccurate rendered light. Using PWM, the LED response can be improved thus resulting in a better rendering.

Preferably, for any of the devices disclosed above, the device further comprises a source of time information and selecting a target colour comprises selecting a target colour depending a time information provided by said source of time information. Thus allowing the usage of the device for applications where is needed a time evolution of the emitted light, for example, emulating cycles of daylight. In this document, the concept of time information is not limited to hours and minutes but can extend to any time measurement. Preferably, said source of time information comprises a real-time clock, RTC, thus being able to provide time and date information in a component that can be easily incorporated in the device.

Preferably, for any of the devices disclosed above, the device further comprises a sensor module, connected to said control module, and comprising at least one sensor configured to provide environmental information to said control module, and wherein selecting a target colour to be generated comprises selecting a target colour depending on said environmental information. Preferably, said at least one sensor comprises a light sensor. Thus, the device can adapt the light generation depending on environmental factors such are ambient illumination and its intensity, but also in regards of environmental conditions like changing the illumination due to a detection of smoke in the area, disconnecting the light if no movement is detected in the area, etc.

Preferably, for any of the devices disclosed above, said device further comprises an auxiliary module, having a secondary control module, configured to act as a master control module when connected to the control module of the device, thus controlling any of the steps of:

selecting said target colour;

modifying said output model; and modifying said the weighted combination obtained from said output model;

or any combination thereof.

Those skilled in the art will understand that modifying the output model can be done in multiple equivalent ways, in particular, by overwriting it in the storage means or by using a secondary storage means provided in the auxiliary module. Therefore, this type of auxiliary modules can be used to modify the behaviour of the device, using a different output model and weighted outputs, and even using the device for other applications different from the one initially configured. It can be implemented as a substitution of the device's control module or, alternatively, as a module for updating the configuration of the device. This provides more flexibility and allows the device to be used in different environments without changing its internal components.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1A:
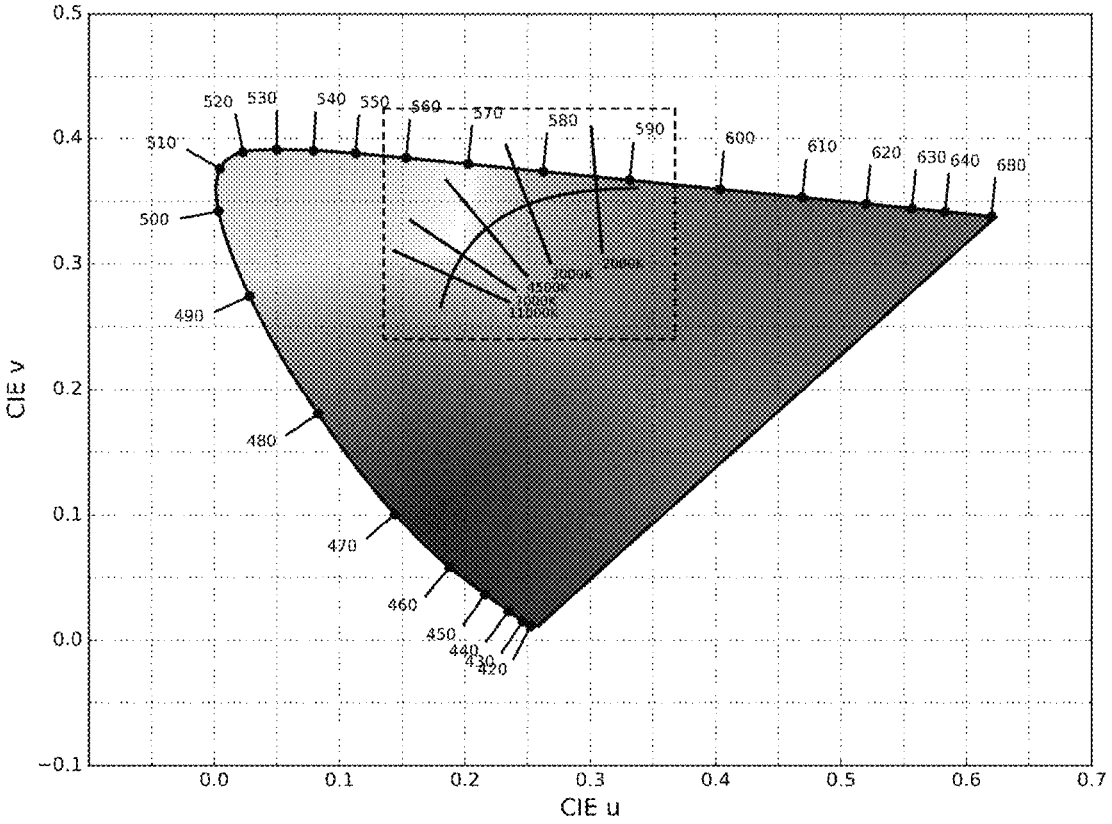
FIG. 1A shows the CIE 1960 UCS Chromaticity Diagram. The figure includes a representation of the Planckian locus as an internal curve.
Figure 1B:
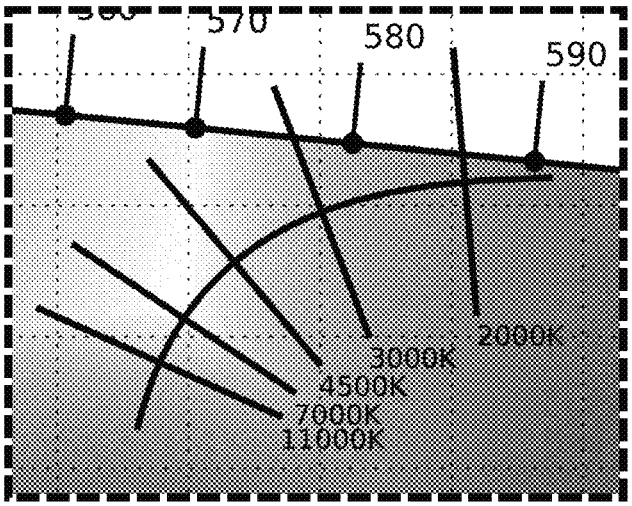
FIG. 1B is a close-up sample of the FIG. 1A, zooming the area showing the Planckian locus. The perpendicular lines correspond to different CCT having temperatures displayed in Kelvin.

FIGS. 1A and 1B show the CIE 1960 UCS Chromaticity Diagram. The numbers at the outer line correspond the wavelength of pure colours, in nanometres. The curve inside the diagram correspond to the Planckian locus and an area surrounded by dashed lines in FIG. 1A is zoomed-in in FIG. 1B. The figures also show five lines corresponding to different CCT values: 2000K, 3000K, 4500K, 7000K and 11000K. For each line, all points located on the line have the same CCT. The distance from the point to the Planckian locus is referred as Duv.

Figure 2:
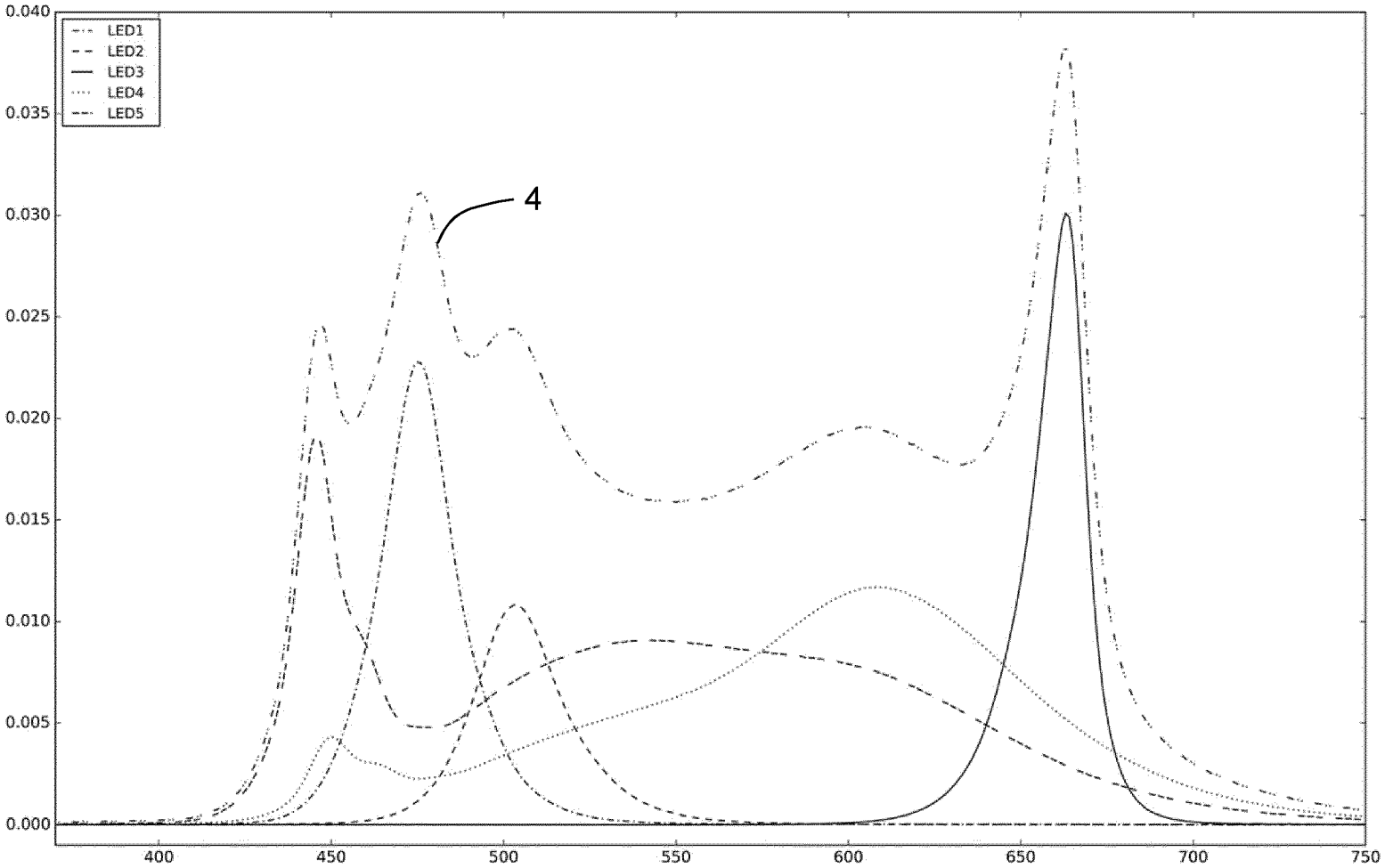
FIG. 2 shows an exemplary mixed spectrum corresponding to a weighted combination of five different types of LEDs, each having an emission spectrum, where the value of all the weights is 1.

The figures illustrate a method for generating target lights starting from a plurality of light sources 2, each having an individual emission spectrum. FIG. 2 shows the five types of light sources, in this case LEDs, used in this embodiment, and their corresponding emission spectra. In particular, the exemplary embodiment uses the following LED models:

LED1: Blue LEDs: Lumileds Luxeon Z (LXZ1-PB01)

LED2: Green LEDs: Lumileds Luxeon Z (LXZ1-PE01)

LED3: Red LEDs: Lumileds Luxeon Z (LXZ1-PA01)

LED4: Warm White LEDs: Osram GW SBLMA2.EM-GUHQ-XX58-1-65-R18

LED5: Cool White LEDs: Osram GW SBLMA2.EM-HPHR-XX51-1-65-R18

The method comprises the steps of:

selecting a target colour from a target region of a colour space; and emitting a target light 6 from said light sources 2 according to a weighted combination of light sources 2 corresponding to said target colour.

In the exemplary embodiment, the colour space used is CIE 1976 L*u*v, also known as CIELUV. It is a particularly advantageous colour space because it has perceptual uniformity. Nevertheless, other examples use other colour spaces, for example, CIE 1931 XYZ or CIE 1960 UCS.

The target light 6 has an emission colour corresponding to the chromaticity coordinates of said target light 6, in this case, the u' and v' coordinates of CIELUV.

For said target colour, said weighted combination is obtained from an output model 3 which is optimized according to an optimization parameter. In the case of the example, the optimization parameter is IES TM-30-15 Rf, which is and advantageous Colour Fidelity parameter, which is considered to be more accurate for representing light quality than other Colour Fidelity parameters such are CRI or Colour Quality Scale, CQS.

The output model 3 is previously determined in a modelling stage comprising the following steps:

Calculating a plurality of mixed spectra 4, each being a weighted combination of said individual emission spectra of said plurality of light sources 2. An example of a mixed spectrum 4 is shown if FIG. 2. In this case is an equal-weighted combination of the five LED types.

For each mixed spectrum 4 of said plurality of mixed spectra 4, calculating its colour coordinates: u' and v' for the example with CIELUV. Also calculating its optimization parameter, which in this example is Rf.

Partitioning in sectors a modelling region 5 of said colour space. The example uses a grid of rectangular sectors in the CIELUV colour space. In the example, the modelling region 5 contains the target region 7.

For each sector, selecting an optimized mixed spectrum as the mixed spectrum contained in said sector having the best optimization parameter; thus obtaining an optimized weighted combination for said colour sector, as the weighted combination of said optimized mixed spectrum. Therefore, for the example, for each sector it will be selected the mixed spectrum having a higher Rf value calculated in the previous step. In the case that a particular sector in the modelling region 5 does not contain any suitable mixed spectrum, the exemplary embodiment has an interpolation step to provide one interpolated mixed spectrum based on its neighbouring sectors.

Using the optimized weighted combination of each of said sectors, establishing a correspondence between colour coordinates and weighted combinations for the target region 7 of the colour space.

Thus obtaining said output model 3.

Figure 3:
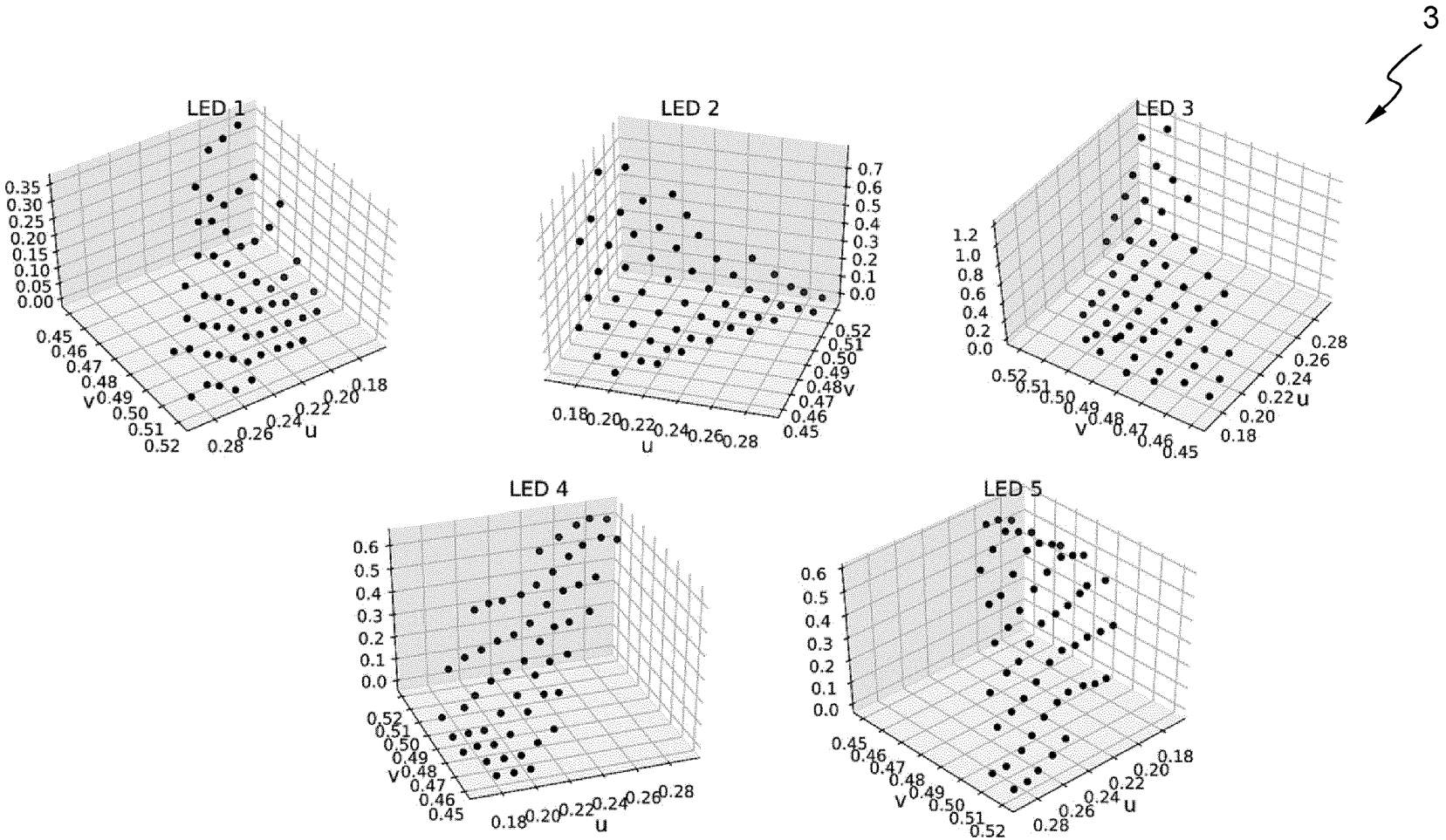
FIG. 3 shows a graphical representation of one exemplary output model according to the invention, using CIELUV.

In the case of the example, the target region 7 is contained in the modelling region 5 and is partitioned in sectors that are a subset of the sectors of the modelling region 5. The output model 3 comprises a plurality of individual look-up tables, one for each light source 2 of said plurality of light sources 2. Each look-up table relating ranges of colour coordinates with a corresponding weight of its corresponding light source 2. Each range relates to a particular sector of the target region 7. In some embodiments, the interpolation step mentioned above is not done for the modelling region 5 but for the target region 7. FIG. 3 shows a graphical representation of the type of output model 3 used by the example. In the figure, a graph is shown for each LED type and relates a bi-dimensional colour coordinates to a weight for the LED. Thus, each point of the graph corresponds to the weight of the LED type for a particular sector of the modelling region 5. The diagrams of FIGS. 3 and 4 have been created to illustrate the type of output model 3 of the exemplary embodiment and its structure, but do not necessarily represent the values obtained for the embodiment. Likewise, other colour spaces can be used within the scope of the claims.

In the example, since the target region 7 is finite and segmented, there is a finite number of a plurality of emission colours that can be chosen.

An equivalent implementation used in other embodiments use a look-up table relating ranges of colour coordinates with a corresponding weighted combination. In this sense, the single look-up table contains the weights for all the LED.

Figure 5A:
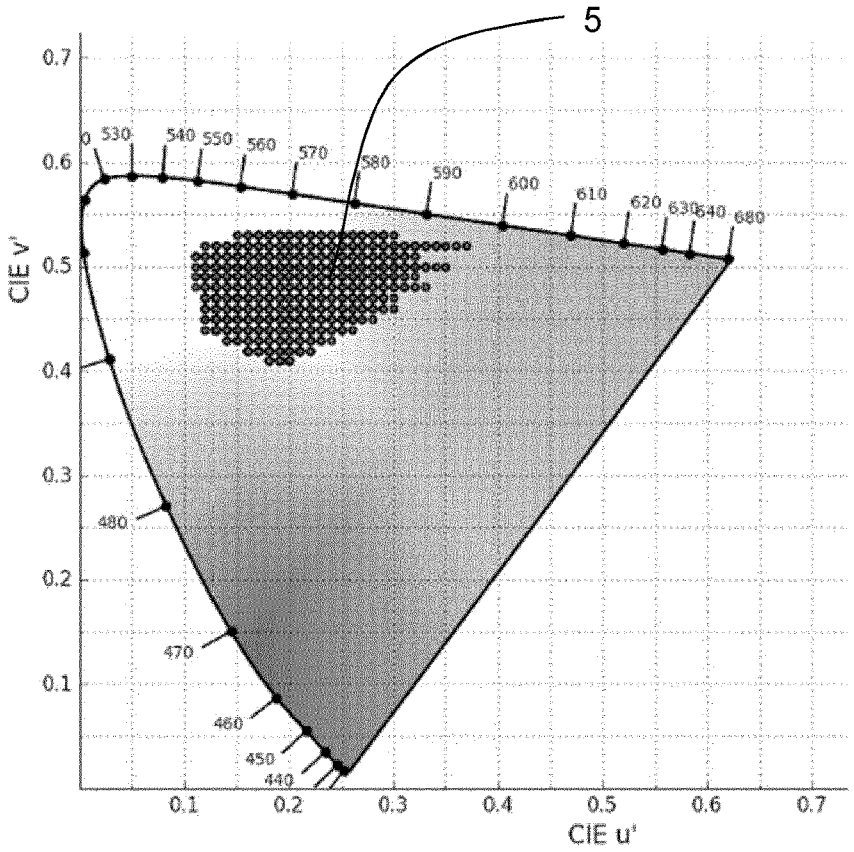
FIG. 5A shows a modelling region in the CIELUV diagram that has been segmented, and where the points correspond to the central points of each segment. The size and shape of each point are just graphical marks without any associated repercussion.
Figure 5B:
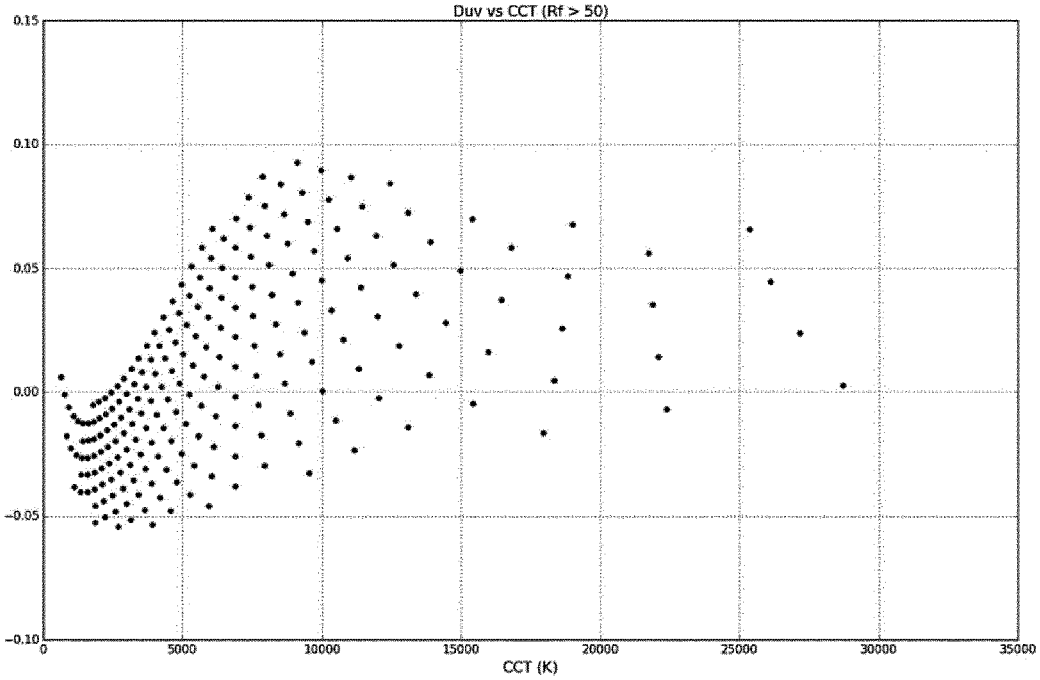
FIG. 5B shows the same points than FIG. 5A transformed to the Duv-CCT diagram.

FIG. 5A shows an example of a modelling region 5 in the CIELUV colour diagram, showing different points each corresponding to the optimized mixed spectrum of a sector. FIG. 5B shows the same region transformed to Duv-CCT diagram. It can be noticed that the regular spacing is warped and the position of the points is not uniform.

Figure 10:
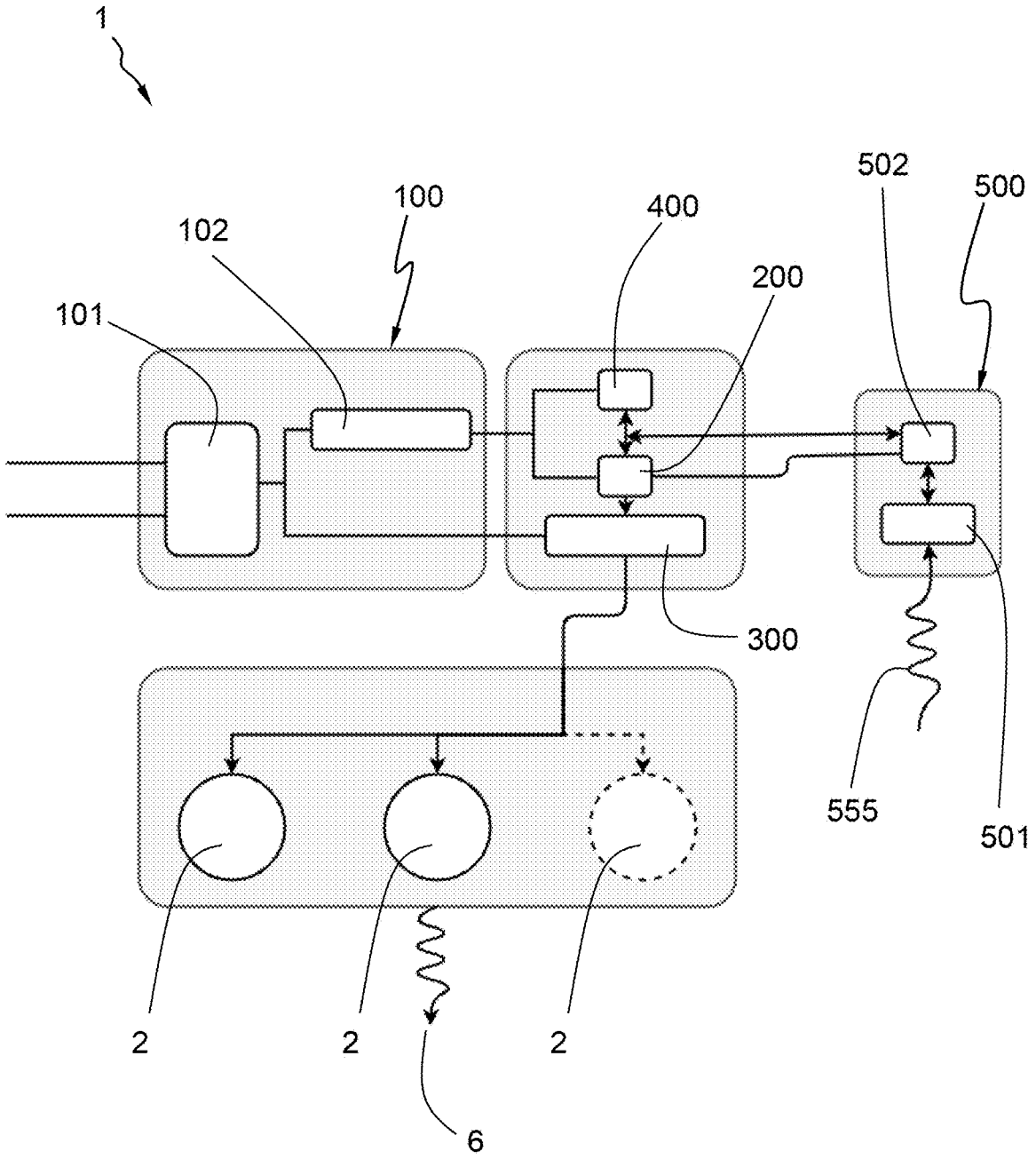
FIG. 10 is a block diagram of an example of a device according to the invention.

FIG. 10 shows an embodiment of a device 1 for generating target lights. Said device 1 having:

A power source 100, that in the embodiment comprises:

an AC/DC converter 101 with a first output voltage; and a DC/DC converter 102, connected to said first output voltage and having a second output voltage, lower than said first output voltage.

A plurality of light sources 2, in the example the five types of LEDs described above, wherein each individual LED is one light radiating element.

A control module 200, in the example, a microcontroller having storage means.

Powering means 300 for said plurality of light sources 2, said powering means 300 being controlled by said control module 200. The exemplary device 1 uses Pulse Width Modulation, PWM; in order to control the amount of power transmitted to the LEDs.

Said first output voltage is connected to the powering means 300 in order to power the LEDs, and said second output voltage is connected to the control module 200.

In the exemplary device 1 there are five light sources 2, each one also referred as a channel and comprising a plurality of LEDs of the same type. In particular, the configuration is as follows:

8 Blue LEDs. Each led powered by a 240 mA input through the powering means 300.

8 Green LEDs. Each led powered by a 240 mA input through the powering means 300.

10 Red LEDs. Each led powered by a 240 mA input through the powering means 300.

80 Warm White LEDs. Each led powered by a 60 mA input through the powering means 300.

80 Cool White LEDs. Each led powered by a 60 mA input through the powering means 300.

Therefore, for the exemplary embodiment of the device 1, the control module 200 is configured to:

Selecting a target colour from said target region 7 of the colour space; and Controlling said powering means 300 for driving said plurality of light sources 2 to emit a target light 6 according to a weighted combination of light sources 2. Said target light 6 having an emission colour from a plurality of emission colours, since the target region 7 is segmented.

Said control module 200 is further configured to, for said target colour, obtaining said weighted combination from the output model 3 as described above, and that is optimized in terms of Rf parameter. In addition, for the exemplary device 1, the target colour is selectable by said control module 200 at least for the target region 7.

With the LED combinations and the exemplary embodiment of the method, the device 1 grants that at least a 50% of those emission colours of said plurality of emission colours that are located within said target region 7 fulfil a quality criterion that, in this example, correspond to having an IES TM-30-15 Rf parameter, with a value of at least 50. In particular, the example grants an even higher value, reaching an Rf of at least 80 for a target region 7 defined in a Duv-CCT diagram by straight lines, each successively connecting the following points:

P1: CCT=1946 K, Duv=−0.0083;
P2: CCT=3395 K, Duv=0.011;
P3: CCT=7456 K, Duv=0.04;
P4: CCT=10000 K, Duv=0.0122;
P5: CCT=10000 K, Duv=−0.0007;
P6: CCT=2971 K, Duv=−0.026; and
P7: CCT=1946 K, Duv=−0.0099.

Figure 7:
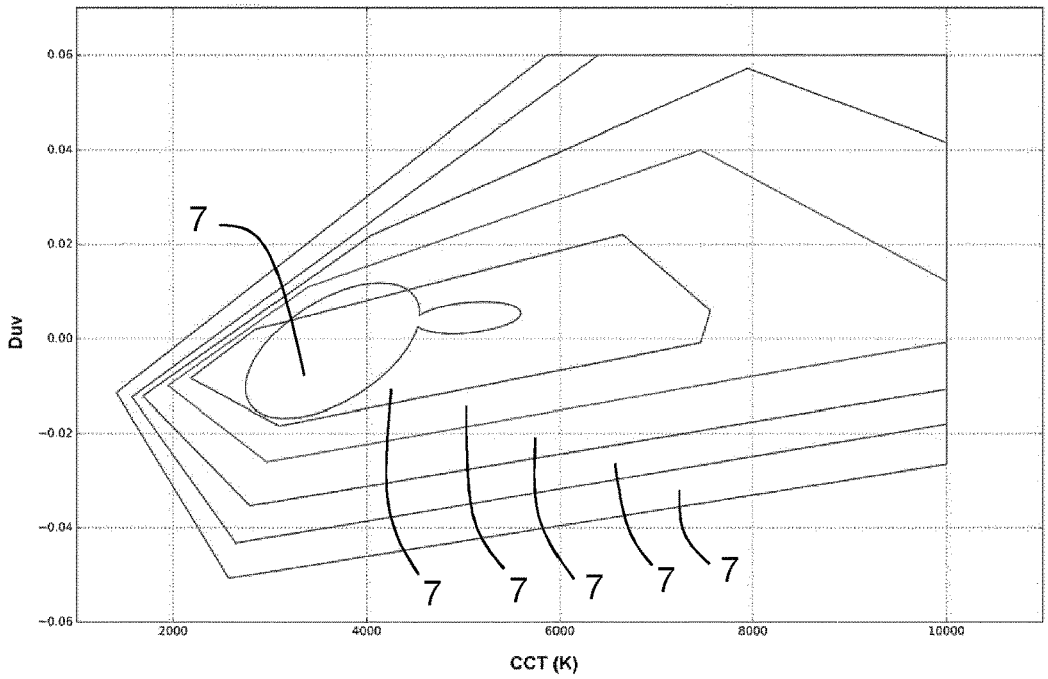
FIG. 7 shows different target regions for different embodiments of the device according to the invention in the Duv-CCT diagram.
Figure 8:
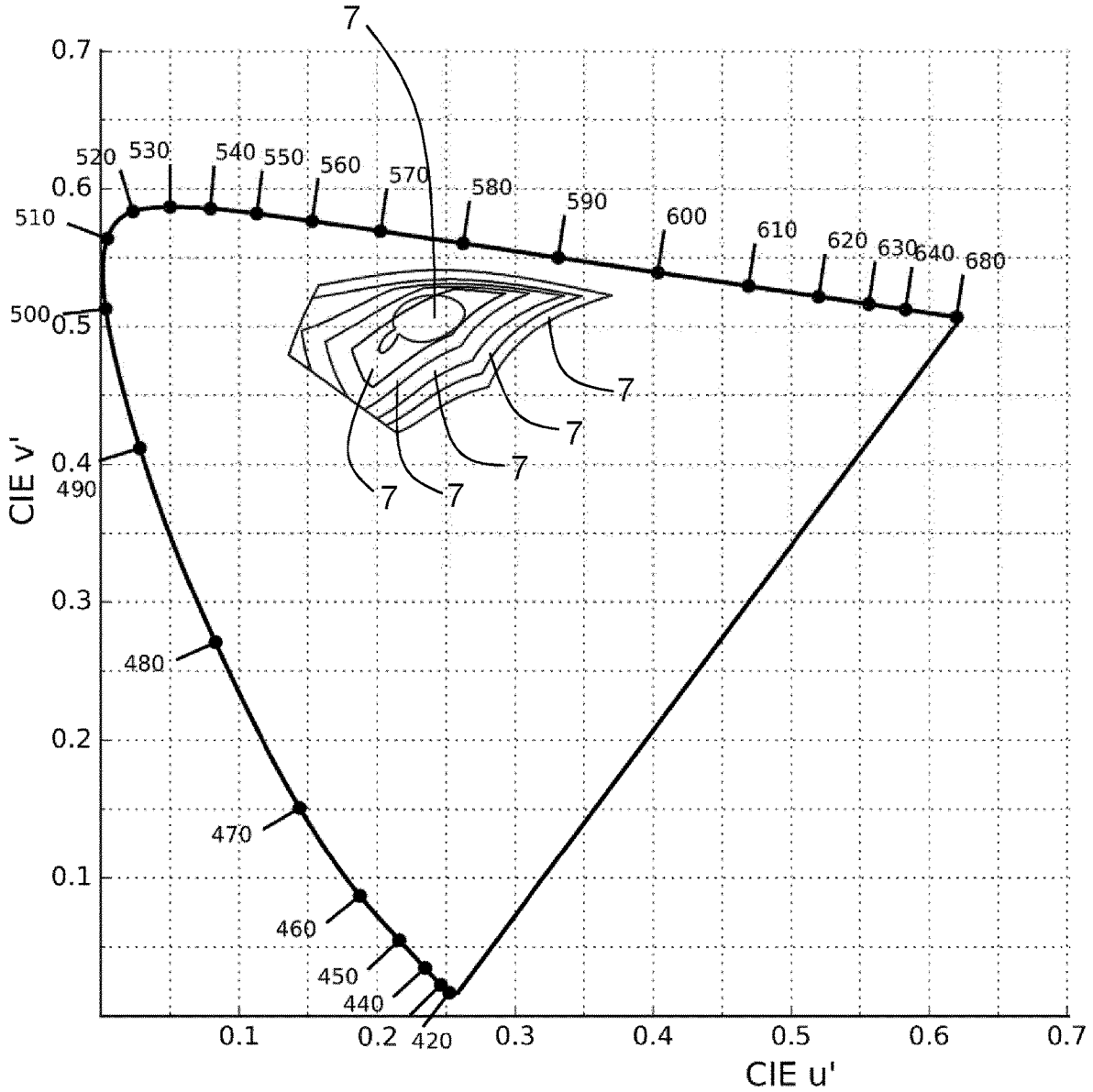
FIG. 8 shows the same target regions that FIG. 7, transformed to CIELUV diagram. The lines between the different points are not straight in this case.
Figure 9A:
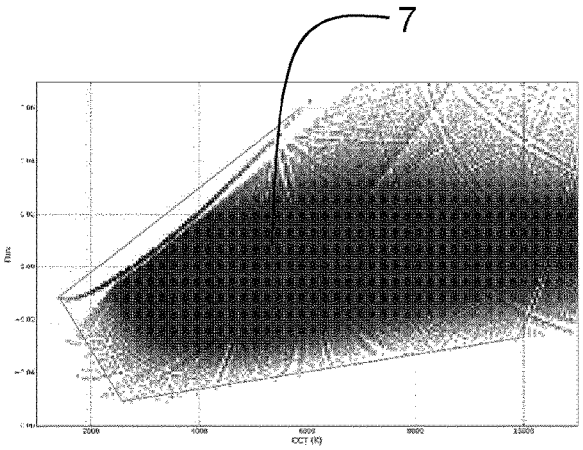
FIGS. 9A to 9E show different target regions for different Rf values. They correspond to a quality criterion where Rf is at least 50, 60, 70, 80 and 90, respectively. The dots represent the optimized mixed spectra of each sector of the modelling region that fulfil the quality criterion of each figure.
Figure 9B:
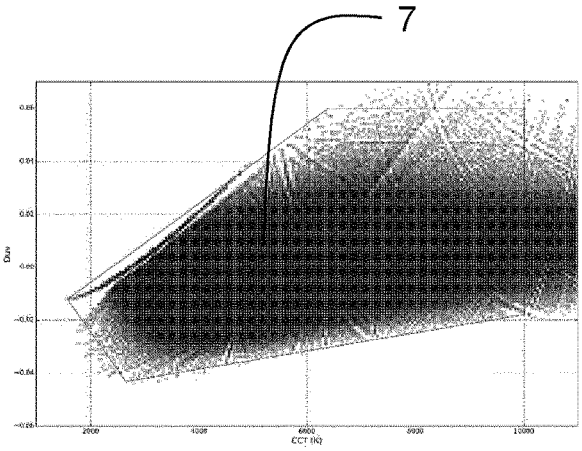
Figure 9C:
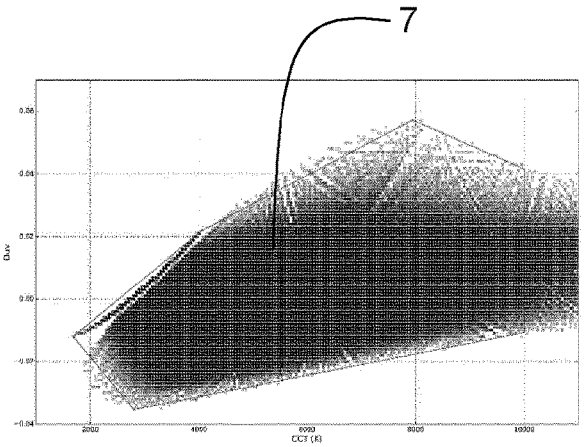
Figure 9D:
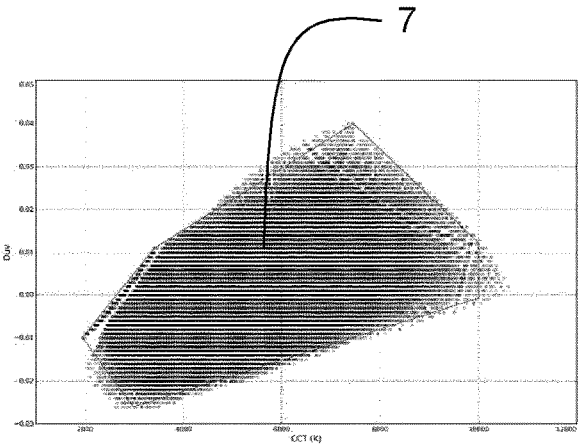
Figure 9E:
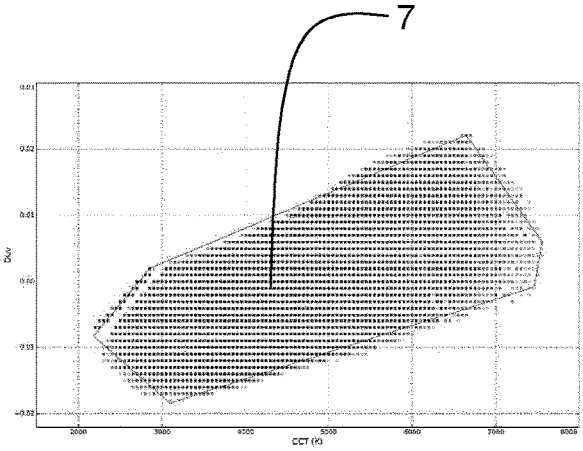

This target region 7 is shown in FIGS. 7, 8 and 9A and contains another being defined by the area contained in any of a first ellipse 51 and a second ellipse 52, both ellipses 51, 52 described by the general formula:

$$\frac{((x-h)\cos(A)+(y-k)\sin A)^2}{a^2}+\frac{((x-h)\sin(A)-(y-k)\cos A)^2}{b^2}=1$$

wherein x corresponds to CCT, measured in Kelvin K; and y corresponds to Duv;

wherein, for said first ellipse 51:

h=3650
k=−0.0025
A=8.737×10$^{-6}$ in radians
a=900
b=0.012 and for said second ellipse 52:

h=5050
k=0.0045
A=1.745×10$^{-6}$ in radians
a=550
b=0.0032.

Figure 6:
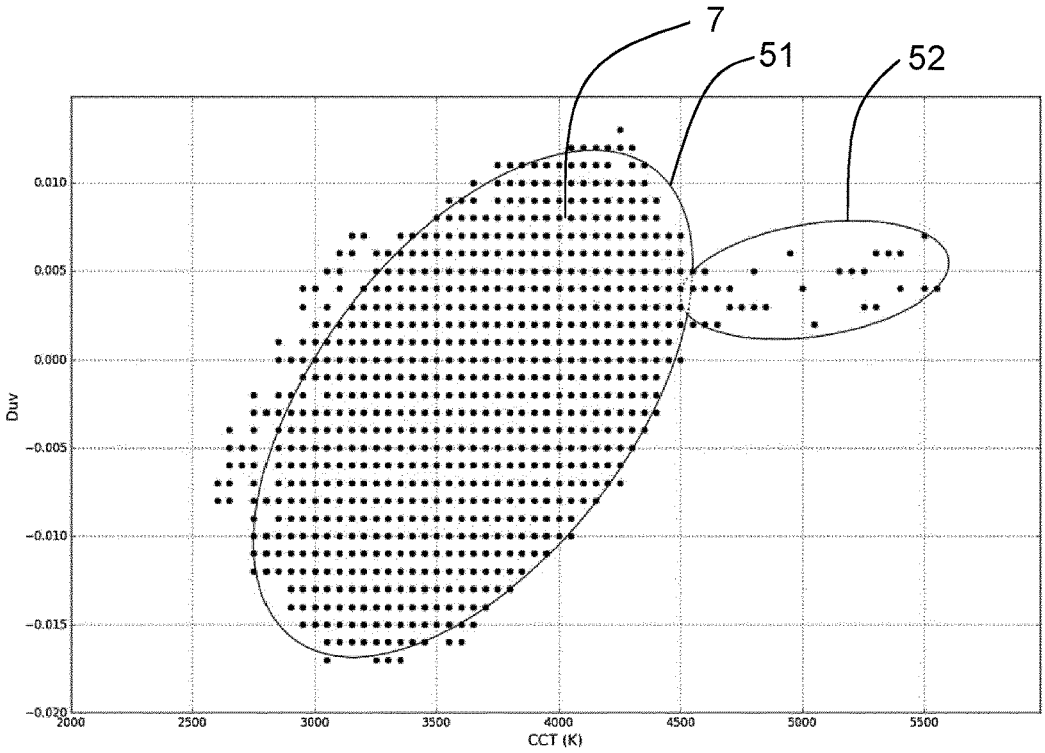
FIG. 6 shows the target region for one exemplary embodiment of the device of the invention. The figure shows the first and second ellipses that define the target region boundaries. Dotted line has been used in the intersection of the ellipses in order to show their shapes. The dots correspond to target lights having an Rf greater than 50 for one exemplary embodiment.

The smaller region defined by the ellipses 51, 52, is also shown In FIGS. 6, 7 and 8.

As shown in FIG. 10, the device 1 further comprises a source of time information 400, in the example, a real-time clock, RTC. This time information 400 provided by the RTC is used in order to select the target colour, thus being able to change also according to the time of the day.

In addition, the device 1 further comprises an optional sensor module 500, which in the example comprises a light sensor 501 and a secondary control module 502. The sensor module 500 is detachably connected to the device 1 and is configured to provide environmental information to said control module 200, in particular, light measures. Then, when selecting a target colour to be generated, the environmental information is used. In FIG. 10 said environmental information is represented as an undulated line 555 arriving to the sensor 501. The sensor 501 is connected to a secondary control module 502 which is used to codify the environmental information and communicate with the control module 200. In some embodiments the secondary control module 502 is used to provide extra functionalities like re-programing the correspondence between colours and weighted outputs in the control module 200, or the calculation of new chromaticity coordinates to be rendered by the device 1 depending on the environmental light colour detected by the sensor 501.

Other exemplary embodiments comprise an auxiliary module, having a secondary control module 502, configured to act as a master control module when connected to the control module 200, thus controlling the step of selecting said objective colour and/or modifying said correspondence between colours and weighted outputs stored in said storage means 500. For example, by connecting an auxiliary module to the device that is initially configured to simulate daylight conditions, it can be updated to maximize the colour gamut and generate light optimised for saturating the illuminated objects.

Further embodiments do not comprise any external sensor module 500.

The following embodiments share most of the elements disclosed above. Therefore, hereinafter only the differentiating elements will be mentioned, while the common characteristics are disclosed in the above embodiments.

In some embodiments, different light sources 2 are used. In many embodiments the light sources are LEDs of different types, a least three types of LEDs. In particular, some embodiments use a combination of red, green and blue LEDs in order to render different light spectra.

In some embodiments the colour space used is CIE 1931 XYZ or CIE 1960 UCS. Other possible embodiments use other colour spaces.

Further embodiments use other optimization parameter. Some possible examples are:

Other Colour Fidelity parameters, such are CRI or Colour Quality Scale, CQS.
Colour Gamut, such are Gamut Area Index, GAI or IES TM-30-15 Rg.
Circadian Factor.
Luminous Efficacy of Radiation, LER.
Energy Efficiency.

In some embodiments the optimization parameter correspond only to one of the above-mentioned parameters. In other embodiments the optimization parameter comprises more than one parameter, for example, a linear combination of the parameters above.

Figure 4:
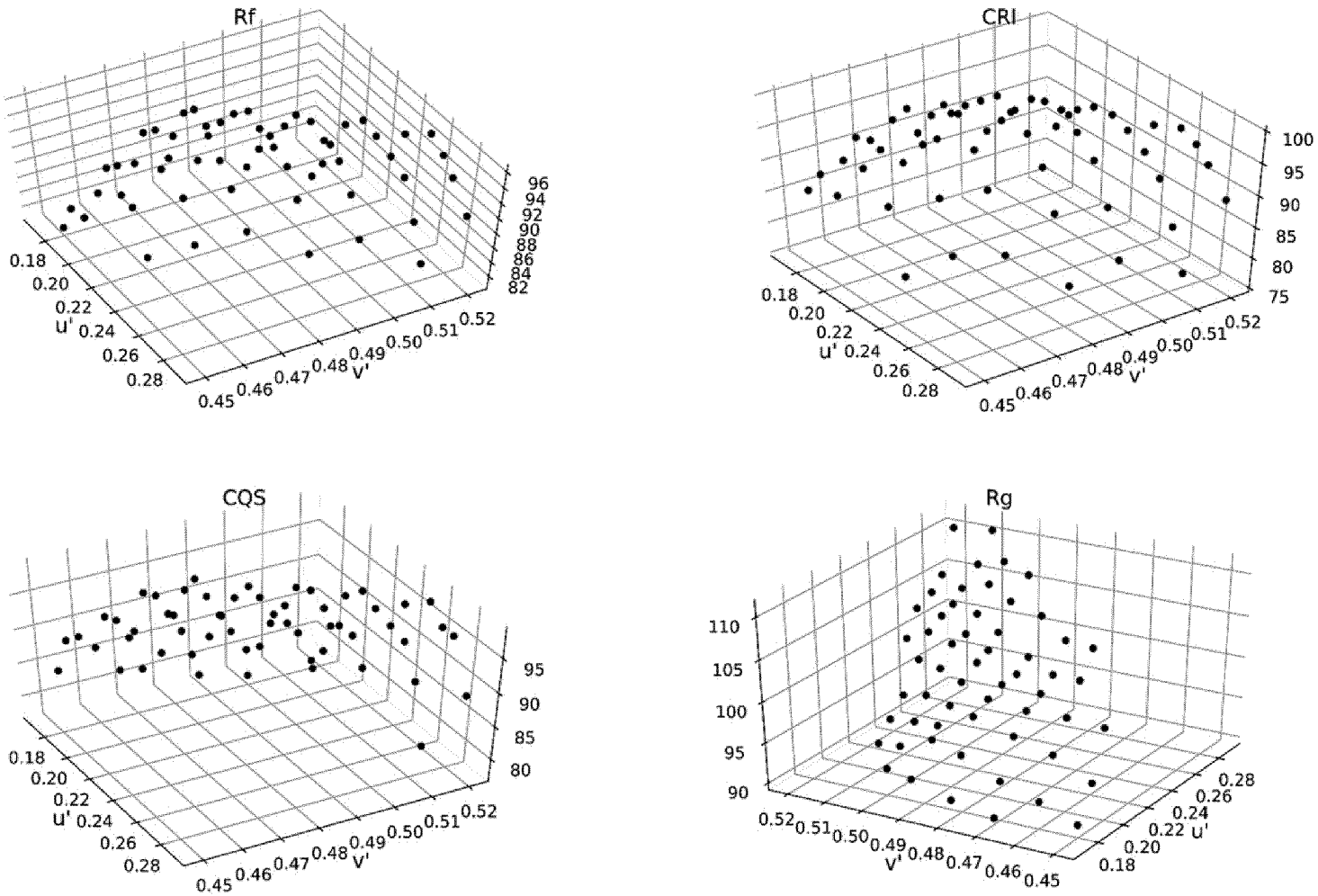
FIG. 4 shows the results of different quality indicators for the example shown in the FIG. 3, also using CIELUV.

FIG. 4 shows an example of different possible calculated quality indicator parameters in terms of its colour coordinates for each of the optimized weighted combinations.

In further embodiments, the output model 3 comprises a plurality of independent mathematical functions, one for each light source 2 of said plurality of light sources 2, and each having as an input colour coordinates and having as an output a corresponding weight of said light source 2. In some examples, functions can be obtained from a function-fitting of a cloud of points corresponding to the optimized weighted combinations. In these cases, the interpolation step can even be avoided because the function-fitting already assigns values for each point.

An equivalent implementation used in other embodiments is a mathematical function having as an input colour coordinates and having as an output a corresponding weighted combination.

In other embodiments of the device 1, the method of the first embodiment is used but, after selecting the optimized weighted combinations, the target region 7 is selected according to the application needs. These regions are shown in FIGS. 7, 8 and 9 and each one is selected for a particular quality criterion that is a threshold IES TM-30-15 Rf parameter for at least 50% of the target zone 7. Each region is defined in a Duv-CCT diagram by straight lines, each successively connecting a list of points.

In an embodiment, an IES TM-30-15 Rf parameter with a value of at least 50 and the following points are used:

P1: CCT=1411K, Duv=−0.0114;
P2: CCT=5869K, Duv=0.06;
P3: CCT=10000K, Duv=0.06;
P4: CCT=10000K, Duv=−0.0265;
P5: CCT=2576K, Duv=−0.0507; and
P6: CCT=1411K, Duv=−0.0114.

In another embodiment, an IES TM-30-15 Rf parameter with a value of at least 60 and the following points are used:

P1: CCT=1573 K, Duv=−0.0123;
P2: CCT=6394 K, Duv=0.06;
P3: CCT=10000 K, Duv=0.06;
P4: CCT=10000 K, Duv=−0.018;
P5: CCT=2649 K, Duv=−0.0432; and
P6: CCT=1573 K, Duv=−0.0123.

In another embodiment, an IES TM-30-15 Rf parameter with a value of at least 70 and the following points are used:

P1: CCT=1685 K, Duv=−0.0121;
P2: CCT=4046 K, Duv=0.0219;
P3: CCT=7946 K, Duv=0.0572;
P4: CCT=10000 K, Duv=0.0416;
P5: CT=10000 K, Duv=−0.0107;
P6: CCT=2797 K, Duv=−0.0353; and
P7: CCT=1685 K, Duv=−0.0121.

In another embodiment, an IES TM-30-15 Rf parameter with a value of at least 90 and the following points are used:

P1: CCT=2181 K, Duv=−0.0083;
P2: CCT=2851 K, Duv=0.002;
P3: CCT=6648 K, Duv=0.0221;
P4: CCT=7557 K, Duv=0.006;
P5: CCT=7458 K, Duv=−0.0008;
P6: CCT=3095 K, Duv=−0.0184; and
P7: CCT=2181 K, Duv=−0.0083.

The shapes of each target region 7 are shown in FIG. 7 in the Duv-CCT diagram, and in FIG. 8 transformed to CIE-LUV diagram. In addition, FIGS. 9A-9E show each region overlapped with the dots corresponding to the optimized mixed spectra fulfilling the quality criteria. In the figures, the modelling region 5 is the same for all of them, even if the target region 7 is different.

The invention claimed is:

1. A method for generating a target light starting from a plurality of light sources, each having an individual emission spectrum, comprising the steps of:

selecting a target colour from a target region of a colour space; and emitting a target light from said light sources according to a weighted combination of light sources corresponding to said target colour;

for said target colour, said weighted combination is obtained from an output model which is optimized according to an optimization parameter, and wherein said output model is previously determined in a modelling stage comprising the following steps:

calculating a plurality of mixed spectra, each being a weighted combination of said individual emission spectra of said plurality of light sources;

for each mixed spectrum of said plurality of mixed spectra, calculating colour coordinates and an optimization parameter of said mixed spectrum;

partitioning in sectors a modelling region of said colour space;

for each sector, selecting an optimized mixed spectrum as the mixed spectrum contained in said sector having the best optimization parameter; thus obtaining an optimized weighted combination for said colour sector, as the weighted combination of said optimized mixed spectrum;

using the optimized weighted combination of each of said sectors, establishing a correspondence between colour coordinates and weighted combinations;

thus obtaining said output model (3).

2. The method according to claim 1, where said colour space has perceptual uniformity.

3. The method according to claim 1, where said optimization parameter comprises at least one of the following:

Colour Fidelity;
Colour Gamut;
Circadian Factor;
Luminous Efficacy of Radiation, LER; and
Energy Efficiency;
or a combination thereof.

4. The method according to claim 1, where said output model comprises:

a look-up table relating ranges of colour coordinates with a corresponding weighted combination; or a plurality of individual look-up tables, one for each light source of said plurality of light sources, and each relating ranges of colour coordinates with a corresponding weight of the light source that corresponds to said individual look-up table.

5. The method according to claim 1, where said output model comprises:

a mathematical function having as an input colour coordinates and having as an output a corresponding weighted combination; or a plurality of independent mathematical functions, one for each light source of said plurality of light sources, and each having as an input colour coordinates and having as an output a corresponding weight of said light source.

6. The method according to claim 1, where said plurality of light sources comprise LEDs of different types.

7. A device for generating target lights having:

a power source;

a plurality of light sources, each having at least one light radiating element;

a control module having storage means; and powering means for said plurality of light sources, said powering means being controlled by said control module;

said control module being configured to:

selecting a target colour from a target region of a colour space; and controlling said powering means for driving said plurality of light sources to emit a target light according to a weighted combination of light sources;

said control module is further configured to, for said target colour, obtaining said weighted combination from an output model which is optimized according to an optimization parameter, and wherein said output model is previously determined in the modelling stage of the method according to claim 1.

8. The device according to claim 7, where said plurality of light sources comprise LEDs of different types.

9. The device according to claim 7, where said power source comprises an AC/DC converter with a first output voltage; and a DC/DC converter, connected to said first output voltage and having a second output voltage, lower than said first output voltage;

wherein said first output voltage is connected to said powering means in order to power said plurality of light sources, and wherein said second output voltage is connected to said control module.

10. The device according to claim 7, further comprising a source of time information, and wherein selecting a target colour comprises selecting a target colour depending a time information provided by said source of time information.

11. The device according to claim 7, further comprising a sensor module, connected to said control module, and comprising at least one sensor configured to provide environmental information to said control module, and wherein selecting a target colour to be generated comprises selecting a target colour depending on said environmental information.

12. The device according to claim 7, where said target light has an emission colour from a plurality of emission colours, said optimization parameter is a Colour Fidelity parameter and wherein at least a 50% of those emission colours of said plurality of emission colours that are located within said target region fulfil a quality criterion, said quality criterion comprising a Colour Fidelity parameter;

said target region being defined by the area contained in any of a first ellipse and a second ellipse, both ellipses described by the general formula:

$$\frac{((x-h)\cos(A)+(y-k)\sin(A))^2}{a^2}+\frac{((x-h)\sin(A)-(y-k)\cos(A))^2}{b^2}=1$$

wherein x corresponds to CCT, measured in Kelvin (K); and y corresponds to Duv;

wherein, for said first ellipse:

h=3650 k=−0.0025

A=8.737×10$^{-6}$ in radians a=900 b=0.012 and for said second ellipse:

h=5050 k=0.0045

A=1.745×10$^{-6}$ in radians a=550 b=0.0032.

13. The device according to claim 12, where said quality criterion comprises an IES TM-30-15 Rf parameter with a value of at least 50; and wherein the perimeter of said target region is defined in a Duv-CCT diagram by straight lines, each successively connecting the following points:

P1: CCT=1411K, Duv=−0.0114;

P2: CCT=5869K, Duv=0.06;

P3: CCT=10000K, Duv=0.06;

P4: CCT=10000K, Duv=−0.0265;

P5: CCT=2576K, Duv=−0.0507; and

P6: CCT=1411K, Duv=−0.0114.

14. The device according to claim 12, where said quality criterion comprises an IES TM-30-15 Rf parameter with a value of at least 70; and wherein the perimeter of said target region is defined in a Duv-CCT diagram by straight lines, each successively connecting the following points:

P1: CCT=1685 K, Duv=−0.0121;

P2: CCT=4046 K, Duv=0.0219;

P3: CCT=7946 K, Duv=0.0572;

P4: CCT=10000 K, Duv=0.0416;

P5: CT=10000 K, Duv=−0.0107;

P6: CCT=2797 K, Duv=−0.0353; and

P7: CCT=1685 K, Duv=−0.0121.

15. The device according to claim 12, where said quality criterion comprises an IES TM-30-15 Rf parameter with a value of at least 90; and wherein the perimeter of said target region (7) is defined in a Duv-CCT diagram by straight lines, each successively connecting the following points:

P1: CCT=2181 K, Duv=−0.0083;

P2: CCT=2851 K, Duv=0.002;

P3: CCT=6648 K, Duv=0.0221;

P4: CCT=7557 K, Duv=0.006;

P5: CCT=7458 K, Duv=−0.0008;

P6: CCT=3095 K, Duv=−0.0184; and

P7: CCT=2181 K, Duv=−0.0083.

* * * * *